United States Patent [19]

DeSantis et al.

[11] 4,456,445

[45] Jun. 26, 1984

[54] MOUNTING STRUCTURE FOR DIE, PUNCH AND CORE ROD ASSEMBLY FOR COMPACTING POWDER MATERIAL

[75] Inventors: Raymond P. DeSantis, Troy; Herbert J. Puffer, Jr., Garden City, both of Mich.

[73] Assignee: PTX-Pentronix, Inc., Lincoln Park, Mich.

[21] Appl. No.: 533,111

[22] Filed: Sep. 19, 1983

Related U.S. Application Data

[63] Continuation-in-part of Ser. No. 419,815, Sep. 20, 1982, Pat. No. 4,427,352, which is a continuation-in-part of Ser. No. 351,482, Feb. 23, 1982, Pat. No. 4,390,335.

[51] Int. Cl.[3] ..... B30B 11/02

[52] U.S. Cl. ..... 425/78; 425/193

[58] Field of Search ..... 425/78, 352, 353, 354, 425/355, 193, 149

[56] References Cited

U.S. PATENT DOCUMENTS

| | | | |
|---|---|---|---|
| 2,253,003 | 8/1941 | Whipple | 425/78 X |
| 2,338,491 | 1/1944 | Cutler | 425/149 X |
| 2,389,561 | 11/1945 | Stokes et al. | 425/78 |
| 3,191,232 | 6/1965 | Haller | 425/78 |
| 3,328,842 | 7/1967 | Vinson | 425/78 |
| 3,414,940 | 12/1968 | Vinson | 425/78 |
| 3,561,054 | 2/1971 | Smith | 425/78 |
| 3,561,056 | 2/1971 | Smith et al. | 425/78 |
| 3,640,654 | 2/1972 | Smith | 425/78 |
| 3,669,582 | 6/1972 | Smith | 425/78 |
| 3,671,157 | 6/1972 | Smith | 425/78 |
| 3,728,054 | 4/1973 | Bryant | 425/78 |
| 3,868,201 | 2/1975 | Jacobson et al. | 425/78 |
| 4,153,399 | 5/1979 | DeSantis | 425/78 |
| 4,390,335 | 6/1983 | DeSantis et al. | 425/78 |

*Primary Examiner*—J. Howard Flint, Jr.
*Attorney, Agent, or Firm*—Hauke and Patalidis

[57] ABSTRACT

In a die, punch and core rod assembly for a powder compacting press wherein the core rod or rods remain stationary while the punch or punches are reciprocable relative to the die, the invention provides individual longitudinal position adjustment for the core rods by clamping the end of the core rods in a collet-like threaded member such as a slotted set screw threading in a threaded bore in a core rod support member. The core rod support member is preferably in the form of a pair of plates one bolted below the other. The end of each core rod is immobilized in its adjusted position by being disposed in an axial bore in the collet-like threaded member and by being clamped between the sidewalls of a longitudinal slot extending part of the length of the set screw, as a result of the tendency of the slot to close when the set screw is driven through the lower plate with its tapered end engaged with a tapered surface at the end of an aligned bore in the upper plate.

15 Claims, 9 Drawing Figures

FIG.8
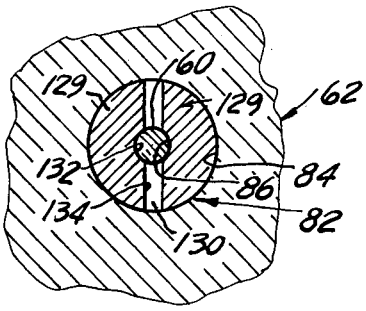
FIG.9
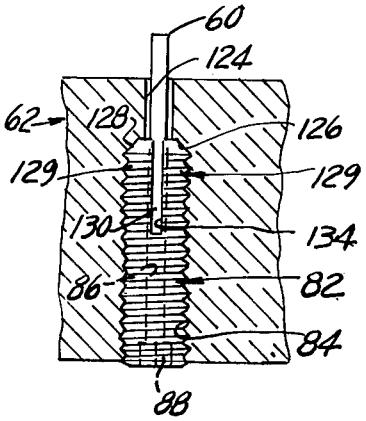
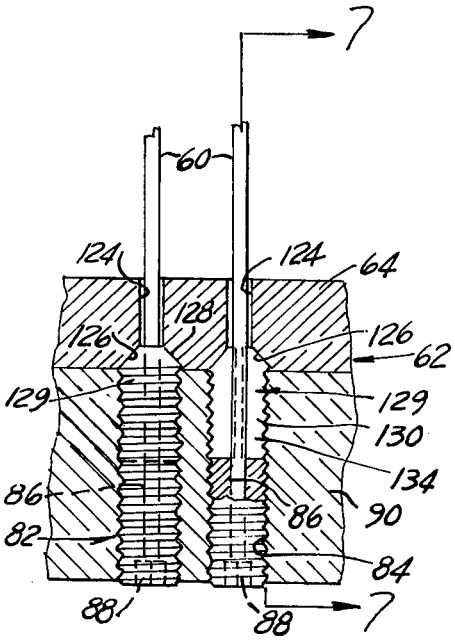
FIG.6
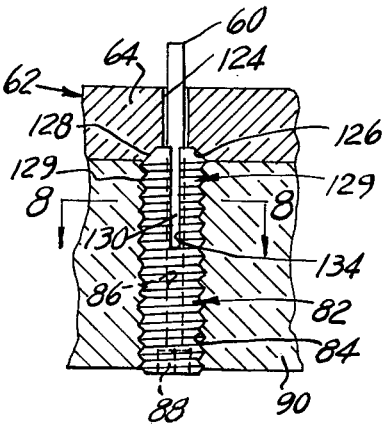
FIG.7

MOUNTING STRUCTURE FOR DIE, PUNCH AND CORE ROD ASSEMBLY FOR COMPACTING POWDER MATERIAL

CROSS-REFERENCE TO RELATED PATENTS AND PATENT APPLICATIONS

The present application is a continuation in part of application Ser. No. 419,815, filed Sept. 20, 1982, now U.S. Pat. No. 4,427,352 which is a continuation in part of application Ser. No. 351,482, filed Feb. 23, 1982, now U.S. Pat. No. 4,390,335, issued June 28, 1983, all assigned to the same assignee. The present application is on an improvement on the punch and die assemblies for compacting powder material disclosed and claimed in U.S. Pat. Nos. 3,328,840, 3,414,940, 3,561,056, 3,574,892, 3,621,534, 3,640,654, 3,669,582, 3,671,157, 3,775,032, 3,805,370, 3,822,974, 4,053,267 and 4,153,399, all assigned to the same assignee as the present application.

BACKGROUND OF THE INVENTION

The present invention relates to powder material compacting presses, more particularly to an improved die, punch and core rod assembly for powder compacting presses.

In powder compacting presses as disclosed in U.S. Pat. Nos. 3,328,840, 3,344,213, 3,328,842, 3,414,940, 3,561,054, 3,726,622, 3,741,697, 3,775,032, 3,805,370 and 3,822,974, all assigned to the same assignee as the present application, there are disclosed apparatus such as presses and tools for such presses for compacting powder material, such as powdered metal, ferrite, glass and other materials into diverse articles such as toroids, beads, pellets and the like. In the powder compacting apparatus disclosed in the aforementioned patents, the articles are formed in single or multi-cavity dies, in which reciprocable punches are disposed, by compaction of the powder material between the punch end face and an anvil displaceable over the die cavity so as to overlap the die cavity.

A work station positioner assembly, forming part of the press apparatus, is disposed angularly or linearly movable over the die plate and is provided with three separate or integral elements, a powder dispenser unit, an anvil, and a pick-up head. The powder dispenser unit is first positioned over the die cavity to fill the die cavity with a predetermined amount of powder material. The dispenser unit is then removed from above the die cavity by the work station positioner assembly, and the anvil unit is in turn positioned over the die cavity and clamped in position. The punch is reciprocated upwardly in the die such as to compact the powder material between the punch end face and the anvil. The anvil is then unclamped from above the die cavity and replaced by the pick-up head as a result of further angular or linear motion of the work station positioner assembly. The punch is reciprocated upwardly so as to eject the compacted article from the die cavity into the pick-up head for transfer to a remote station, or, alternatively, for transfer to a collection station by subsequent motion of the work station positioner assembly.

By way of utilizing standardized punch and die assemblies in the form of interchangeable tool capsules, all adapted to be interchangeably mounted on the press table in an appropriate mounting aperture and held therein by any convenient means such as by mounting bolts or clamps, the remaining of the tool capsule projecting below the press table, with the punch actuating mechanism of the press appropriately connected to the punch actuating plate portion of the tool capsule, it is a simple matter after a production run of a particular part to remove a tool capsule and replace it by another tool capsule for compacting a different part. With the exception of the die, the punches, and the core rods, if any, all the other mechanical parts forming the tool capsule are subject to little or no wear. The die, the punch and the core rods, if any, are however subject to important load stresses and to wear, as a result of which they may experience dimensional changes, such as a progressive opening of tolerances, and, if subjected to abnormal loads, they may be damaged beyond repair or even break. It is therefore convenient for the user to provide a tool capsule which can be easily dismantled and which provides easy removal of the die plate or of the die bushings, the punches and the core rods, when they become worn or when they break, for replacement by new die plate or die bushings, punches and core rods. It is also desirable that replacement punches and core rods be reinserted in the tool capsule without too much fuss, and without requiring complicated fixtures and gauges. In tool capsules comprising slender core rods for forming apertures in the compacted article it is also desirable that the core rods be easily replaced, and be adjustable in longitudinal position either individually, or as a group, or both, and, where a plurality of cores are used, that each individual core rod be replaceable without disturbing the position of the others.

The inventions disclosed in prior application Ser. No. 351,482, now U.S. Pat. No. 4,390,335, and in prior application Ser. No. 419,815 relate to die, punch and core rod assemblies, or tool capsules, for powder material compacting presses, provided with a stationary non-adjustable or adjustable core rod mounting plate supporting one or more stationary core rods, permitting removal and replacement of the core rods without requiring the tool capsules to be removed from the press and/or dismantled, and allowing the longitudinal position of the individual core rods to be adjustably pre-set or, in the alternative and in addition, permitting the core rod support to be adjustably pre-set in a longitudinal position.

SUMMARY OF THE INVENTION

The principal object of the present invention is to provide a simple alternate structure for adjustably mounting core rods in a core rod mounting plate supporting one or more stationary core rods, permitting each core rod, once adjusted longitudinally relative to the core rod support plate, to be safely locked in its adjusted stationary position.

A better understanding of the present invention will be obtained by those skilled in the art when the following description of the best modes contemplated for practicing the invention is read in conjunction with the accompanying drawing wherein like numerals refer to like or similar parts and in which:

BRIEF DESCRIPTION OF THE DRAWING

FIG. 6 is an enlarged schematic sectional view of a portion of a core rod support plate useful in explaining the principle of structure and operation of the present invention;

FIG. 7 is a view generally along line 7—7 of FIG. 6;

FIG. 8 is a section along line 8—8 of FIG. 7; and

FIG. 9 is a view similar to FIG. 7, but showing a modification thereof.

DETAILED DESCRIPTION OF THE PREFERRED EMBODIMENT

Figure 1:
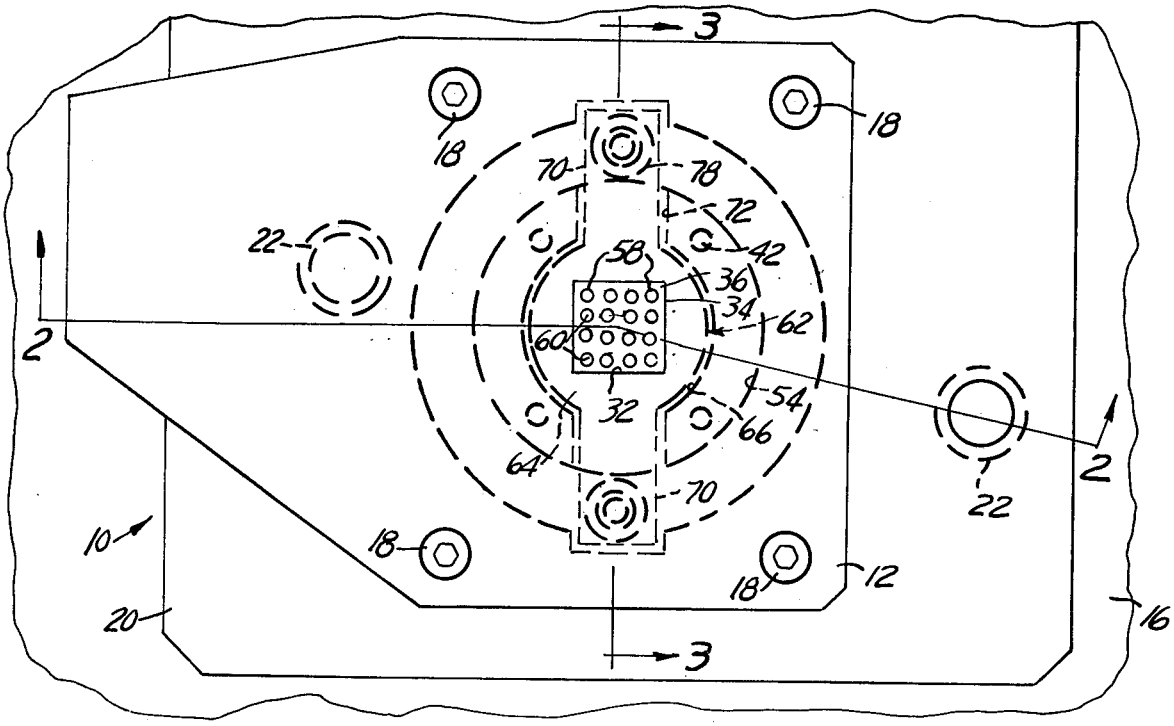
FIG. 1 is a top plan view of a die, punch and core rod assembly, or tool capsule, according to the present invention.
Figure 2:
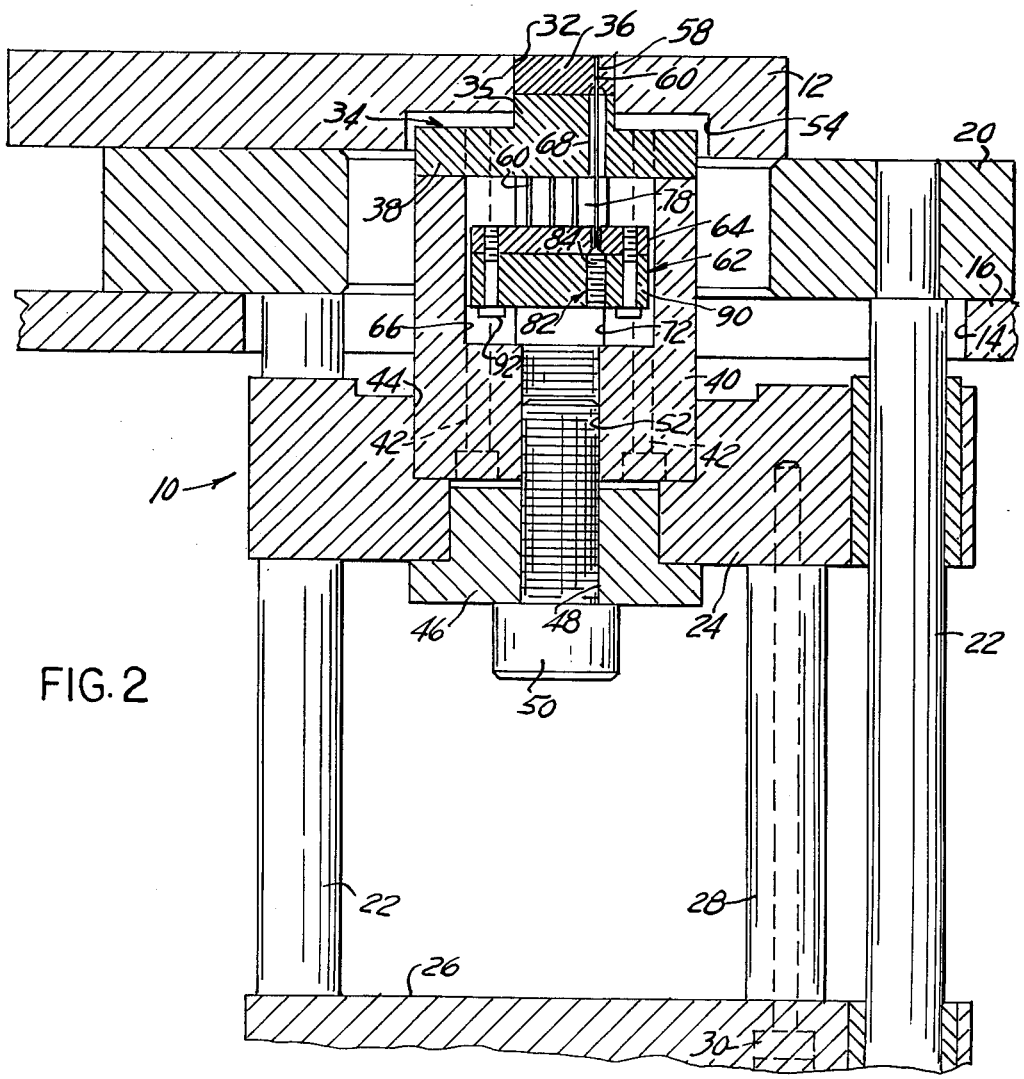
FIG. 2 is a section along line 2—2 of FIG. 1.
Figure 3:
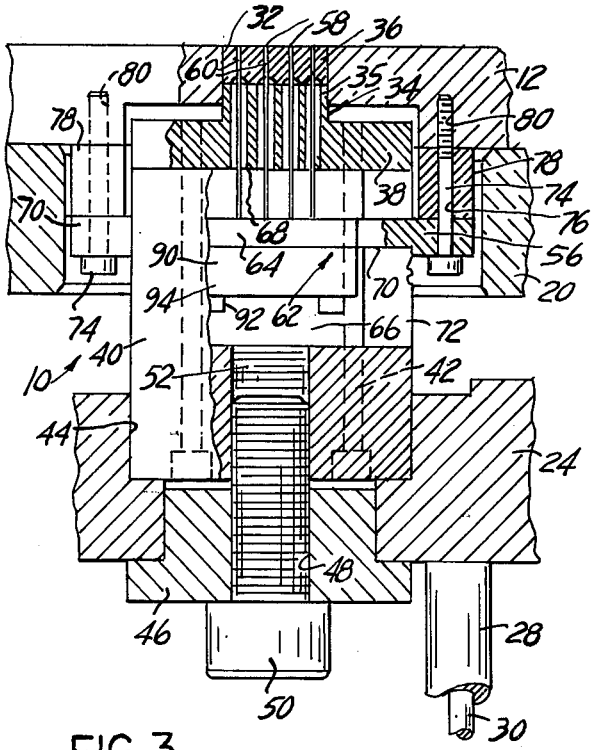
FIG. 3 is a partial section along line 3—3 of FIG. 1.

Referring to the drawing, and more particularly to FIGS. 1–4 thereof, a die, punch and core rod assembly 10, or tool capsule, according to the present invention comprises a die plate 12 adapted for mounting in an opening 14 in the table 16 of a powder compacting apparatus, or press (not shown). The die plate 12 is mounted by means of countersunk screws 18, FIG. 1, on a spacer plate 20 in turn directly bolted or clamped, in a manner not shown, on the top of the table 16 over the opening 14. A pair of parallel spaced apart guide posts 22, mounted below the spacer plate 20, slidably support and guide a punch support plate 24 and a punch actuating platen 26 disposed parallel to each other and in spaced-apart relationship. The punch actuating platen 26 is mechanically connected to the press lower ram, not shown, for reciprocation therewith, and is rigidly connected to the punch support plate 24 by means of spacers such as tubular spacers 28, only one of which is shown, and bolts 30.

The die plate 12, made of heat-treated tool steel or of a metallic carbide, for example, has a die opening or cavity 32 in which is reciprocably disposed a punch 34 which may be made of solid construction but which, preferably, has a top block or insert 36 made of extra hard material such as a metal carbide or the like, and a body portion 35. If so desired, the die plate 12 instead of being directly provided with a die opening 32 may be provided with a fitted die bushing of extra hard material such as a carbide, in turn provided with the die opening or cavity 32.

The punch 34, which, in the example of structure illustrated, has a substantially square or rectangular body portion 35 and insert 36, is formed integral with a circular plate 38 bolted on the top of a generally cylindrical tubular punch base 40 by way of socket head bolts 42. The bottom of the punch base 40 is disposed in a stepped bore 44 in the punch support plate 24 and is solidly attached to the punch support plate 24 by means of a shouldered spacer bushing 46 having a central bore 48 through which is passed the body of a bolt 50 threading through a centrally disposed threaded bore 52 in the bottom of the cylindrical punch base 40. The die plate 12 has a cylindrical recess 54 formed on its lower surface to provide clearance around the punch circular plate 38, and the spacer plate 20 has an opening 56 providing passage therethrough of the punch base 40.

Figure 4:
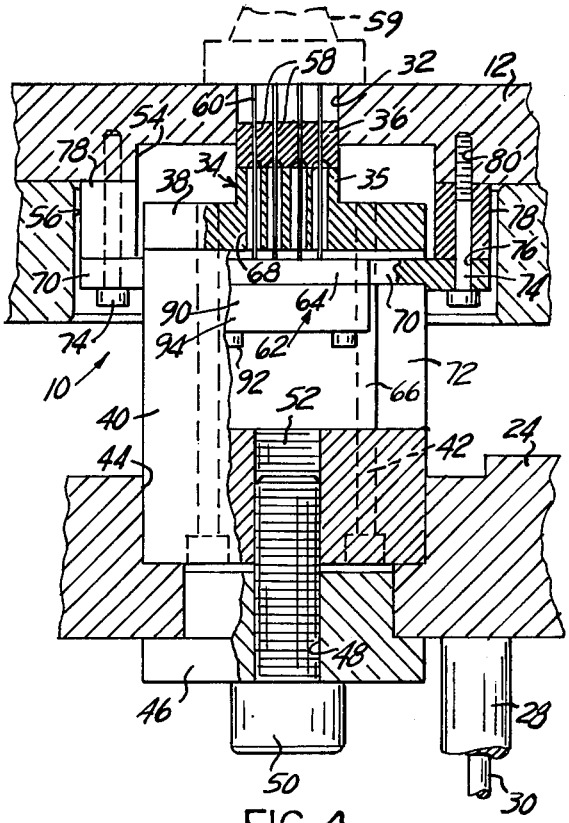
FIG. 4 is a view similar to FIG. 3, but showing the punch element in a retracted position relative to the die element.

The punch 34 has a plurality of longitudinally disposed small bores 58 through each of which is passed a core rod 60. In the example of structure illustrated, the reciprocable punch 34 is designed to compact in the die opening or cavity 32, against the face of an anvil 59, FIG. 4, a substantially square or rectangular part of powder material, the part being provided with apertures, each one corresponding to one of the core rods 60, as is well known in the art. The punch 34 is reciprocated downwardly to a position, for example, as shown at FIG. 4, the tip of the core rods 60 being evenly flush with the top surface of the die plate 12. The die opening or cavity 32 above the retracted punch is filled with powder material from a powder dispenser, not shown, and the anvil 59 is displaced to straddle over the die opening or cavity 32 and clamped in position. The punch 34 is reciprocated towards the anvil 59 such as to compact the powder material in the die opening or cavity 32 against the face of the anvil. Subsequently, the anvil 59 is displaced away from over the die opening or cavity 32, and the compacted part is ejected from the die opening or cavity 32. At FIGS. 2 and 3 of the drawings the punch 34 is illustrated in a position corresponding to ejection of the compacted part from the die opening 32, and at FIG. 4 the punch 34 is illustrated in the approximate position it occupies during filling of the die opening or cavity 32 with powder material, prior to compacting the part, not shown. The core rods 60 are at all times held stationary during reciprocation of the punch 34.

The bridge core rods 60 are supported by a block 62. The block 62 comprises a plate 64 which is freely disposed within a recess 66 in the punch base 40, below the punch support plate 38. The core rods 60 are each disposed through one of the bores 68, FIGS. 2, 3 and 4, in the integral punch plate 38 and punch body 35. The bridge plate 64 of the core rod support block 62 has a pair of diametrically opposed arms 70, FIGS. 3–4, laterally projecting through longitudinal slots 72 formed in the wall of the tubular punch base 40, and the bridge plate 64 of the core rod support block 62 is mounted, bridge-like fashion, below the die plate 12 by means of a pair of bolts 74 each passed through a vertically disposed bore 76 proximate the end of each arm 70 and through the interior of a tubular spacer 78, the end of each bolt 74 threading through an appropriate threaded bore 80 in the die plate 12. In this manner, when the punch support plate 24, supporting the punch base 40 on the top of which the punch 34 is mounted, is reciprocated the core rod support block 62 remains stationary.

Each core rod 60 is mounted longitudinally adjustable relative to the core rod support block 62, as will be explained hereinafter in further details, by being fastened by clamping means taking the form of a collet-like threaded foot member 82 in turn threaded in a threaded bore 84 in a support plate 90. The support plate 90 is mounted below the bridge plate 64 by means of appropriate bolts 92 such that the bridge plate 64 and the support plate 90, in assembly, define the core rod support block 62. The collet-like threaded foot member 82 is preferably in the form of an elongate set screw, having an axially disposed bore 86, FIG. 6, in which is slidably disposed the end of the core rod 60. By introducing the end of a driving tool, such as a hexagonal tip wrench, in the hexagonal socket 88 at the end of the collet-like foot member 82, each core rod 60 may be adjustably positioned relative to the core rod block 62 such that the tips of all the core rods 60 are disposed at an even level which correspond, for anvil pressing, to the top edge of the die opening 32, FIG. 4.

Figure 5:
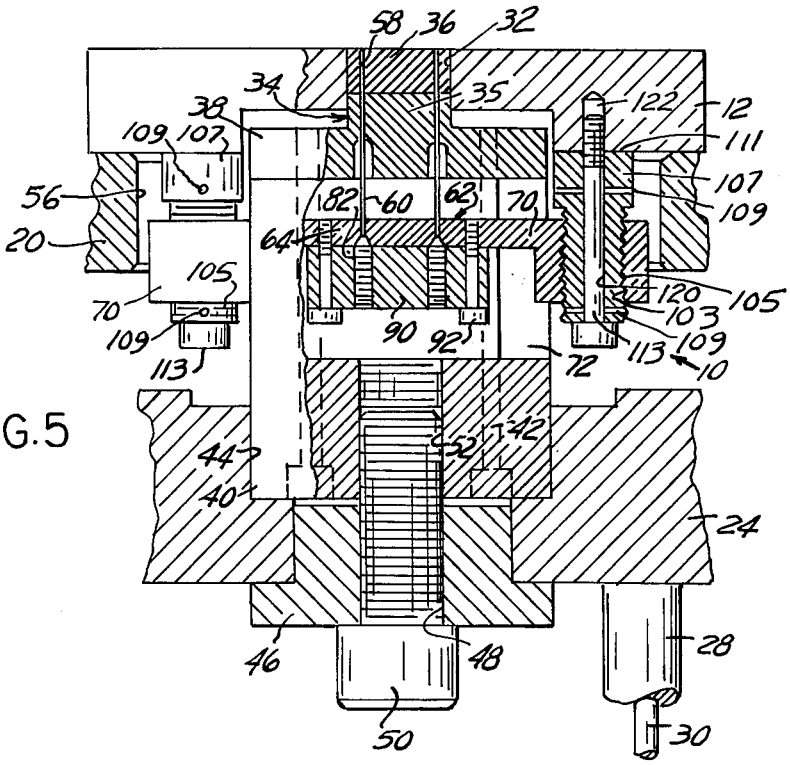
FIG. 5 is a view similar to FIG. 3 but showing a modification thereof.

At FIG. 5 there is illustrated a structure for a die, punch and core rod assembly 10 substantially similar to the structure of FIGS. 1–4, but wherein the core rod support block 62 is adjustably mounted below the die plate 12, such as to provide longitudinal positioning of the core rods 60 as a group. For that purpose, each arm 70 of the core rod support block 62, projecting from the punch base 40 through the slots 72, has a threaded bore 103 in which is disposed the peripherally threaded portion 105 of a spacer sleeve 107. The spacer sleeve 107 has a plurality of radial bores 109 permitting to rotate the spacer sleeve 107 by means of a tool in the form of a rod introduced through a radial bore 109, such that each of the spacer sleeves 107 may be extended from the top of the arm 70 of the core rod support plate or block 62 to space the core rod support block 62 from the die plate 12, with the end face 111 of each spacer sleeve 107 engaging the bottom surface of the die plate 12. A pair of mounting bolts or hexagonal socket head screws 113, each passed through the internal bore 120 of a spacer sleeve 107 and threading through an appropriate threaded bore 122 in the bottom of the die plate 12, securely affix the core rod support block 62 an appropriate distance below the die plate 12, such that the tips of all the core rods 60 are fixedly disposed where required in the die opening or cavity 32, for example even with the edge of the die cavity. As the longitudinal position of each core rod 60 is individually adjustable relative to the core rod support block 62 such a structure provides for both individual adjustment and for adjustment of the position of the support block 62 relative to the die plate 12.

Once a correct longitudinal position of each core rod 60 has been achieved, the core rod is securely held in its adjusted longitudinal position as a result of the specific clamping structure provided for the core rod support block 62, as illustrated in details at FIGS. 6–8. The core rod support block 62 comprises the bridge plate 64 and the support plate 90 bolted therebelow. The support plate 90 is provided with vertically disposed threaded bores 84 each accepting one of the core rods collet-like threaded members 82. The bridge plate 64 has a vertically disposed bore 124 axially aligned with each threaded bore 84 in the support plate 90, the diameter of each bore 124 in the bridge plate 64 being greater than the outer diameter of each corresponding core rod 60 being passed therethrough when slidably disposed in the bore 86 in each collet-like threaded foot member 82. Each bore 124 in the bridge plate 64 is countersunk at its end proximate to the support plate 90 such as to form a tapered or frusto-conical abutment annular surface 126 engageable by a corresponding tapered or frusto-conical tip 128 at one end of each collet-like threaded foot member 82. Each collet-like threaded foot member 82 has a bifurcated end provided with parallel segments 129 supported by a diametrical slot 130 extending, for example, from mid-distance between the ends of the threaded member 82 to its tapered tip 128. Preferably, the slot 130 has a width slightly less than the diameter of the core rod 60, and is provided with a shallow groove 132, FIG. 8, in each sidewall 134. Each shallow, vertically disposed, groove 132 slidably engages a portion of the peripheral surface of the core rod 60, when the tapered tip 128 of threaded member 82 is free of the tapered abutment surface 126 allowing the core rod 60 to be slidably adjustable longitudinally within the bore 86 in the collet-like threaded foot member 82. With the threaded member 82 tightened against the bottom of the threaded bore 84 causing the threaded member tapered tip 128 to forcibly engage the tapered abutment annular surface 126, the segments 129 are elastically deflected inwardly, thus solidly clamping the end of the core rod 60 in the slot 130.

In order to adjust the longitudinal position of a core rod 60, the corresponding collet-like threaded foot member 82 is backed up by means of a hexagonal tip wrench introduced in the hexagonal socket 88 in the end of the threaded member 82 sufficiently to allow the segments 129 to relax and thus reduce the pressure applied by the grooved sidewalls 134 of the slot 130 upon the peripheral surface of the core rod 60 as a result of the tapered end 128 of the threaded member 82 not being any longer forcibly engaged with the tapered frusto-conical abutment surface 126 at the bottom end of the threaded bore 84. The core rod 60 may thus be longitudinally adjusted and subsequently securely clamped in position by tightening the collet-like threaded foot member 82 such as to forcibly engage its frusto-conical end 128 with the frusto-conical abutment surface 126, thus causing the slot 130 to close slightly for securely clamping the core rod 60 between the segments 129 and within the shallow grooves 132 in the slot sidewalls 134.

As an example of numerical values, given for illustrative purpose only, core rods 60 of 0.020 in. have been effectively clamped by means of collet-like threaded foot members 82 made of 7/64 diameter, ⅜ long set screws having a 90° tapered end and provided with a slot 130 extending to one-half of their length from the tapered end, the slot being 0.015 wide. Each groove 134 in each wall 132 of the slot 130 was therefore 0.0025 deep.

It will be appreciated by those skilled in the art that the core rod support block 62 may be made in a single piece, although the core rod support block 62 has been described and illustrated as being made of two separate plates, namely the bridge plate 64 and the support plate 90, for facilitating manufacturing. When adopting a single-piece structure for the core rod support block 62, FIG. 9, the bores 124 are first drilled through the block. The bores 124 are subsequently enlarged, to an appropriate depth, to the size of the bores 84 having the tapered surface 126 at their bottom. Subsequently, the enlarged bores 84 are tapped such as to accept the collet-like core rod threaded foot members 82. It will be further appreciated that the collet-like threaded foot members 82 may be provided, for example, with two or more slots 130 disposed diametrally at regular angular positions, or by any other appropriate structure providing a collet-like arrangement gripping and securely clamping the core rods 60 in position within the threaded members 82.

Having thus disclosed the present invention by way of examples of structural embodiments thereof, modifications whereof will be apparent to those skilled in the art, what is claimed as new is as follows:

1. In a punch and die assembly for a powder compacting press comprising a die plate, at least one punch reciprocable relative to said die plate and at least one core rod stationary relative to said die plate, said core rod having an end slidably disposed in a bore through said punch, a punch base member connected to a reciprocable platen supporting said punch, a core rod support block disposed in a recess within said punch base member and having integral support arms projecting through slots in said punch base member, means for attaching the end of said arms below said die plate and means mounting the other end of said core rod in said core rod support block and providing longitudinal adjustment of said core rod relative to said core rod support block, the improvement comprising a first bore in said core rod support block for passage therethrough of said other end of said core rod, a second bore in said core rod support block axially aligned with said first bore, said second bore being internally threaded and having a larger diameter than said first bore, abutment means in said second bore, a threaded member having an axial bore aligned with said first bore and slidably accepting said other end of said core rod, and collet clamping means in said threaded member for gripping said other end of said core rod when said threaded member is threaded in said second bore for forcibly engaging an end of said threaded member with said abutment means in said second bore.

2. The improvement of claim 1 wherein said threaded member is an elongate set screw having said axial bore in which is slidably fitted the other end of said core rod, a longitudinal slot extending part of the length of said set screw and forming a pair of elastically deflectable segments, said deflectable segments having an end formed by said end of said threaded member for engagement with said abutment means for deflecting said segments such as to clamp said end of said core rod between sidewalls of said slot.

3. The improvement of claim 2 wherein said abutment means is a tapered annular surface at an end of said second bore and said end of said threaded member has a correspondingly tapered tip.

4. The improvement of claim 3 further comprising a shallow groove in said slot sidewalls, said groove forming a surface in engagement with a peripheral surface portion of said core rod.

5. The improvement of claim 1 wherein said core rod support block is mounted below said die plate adjustable in position towards said die plate and away therefrom.

6. The improvement of claim 5 wherein said means for adjustably mounting said core rod support block below said die plate comprises a variable length spacer.

7. The improvement of claim 6 wherein said variable length spacer comprises a sleeve member having a peripherally threaded portion, a threaded bore in each of said arms accepting the peripherally threaded portion of said sleeve, and a bolt passed through said sleeve member and threading at its end in a threaded aperture in said die plate.

8. In a punch and die assembly for a powder compacting press, said assembly comprising a die plate, at least one punch reciprocable relative to said die plate and at least one core rod stationary relative to said die plate, said core rod having an end slidably disposed in a bore through said punch, means reciprocably supporting said punch relative to said die plate, and means supporting said core rod at the other end in a stationary adjustable position relative to said die plate, said last mentioned means comprising a core rod support block disposed below said punch, means attaching an end of said core rod to said support block and means attaching said support block to said die plate, wherein said core rod is attached to said core rod support block by means providing longitudinal adjustment of said core rod, the improvement comprising a threaded bore in said support block, abutment means in said threaded bore, a threaded member for threading in said threaded bore, an axial bore in said threaded member for slidably holding said other end of said core rod and clamping means in said threaded member for clamping said other end of said core rod in said axial bore upon engagement of a portion of said threaded member with said abutment means.

9. The improvement of claim 8 wherein said clamping means comprises a longitudinal slot in an end of said threaded member forming a pair of segments forming sidewalls for said slot in surface engagement with a peripheral surface portion of said core rod, said segments having a tip engageable with said abutment means and being elastically deformable toward each other upon engagement of said tip with said abutment means for clamping said core rod peripheral surface portion between said sidewalls.

10. The improvement of claim 9 wherein said sidewalls have a groove forming a surface in engagement with said peripheral surface portion of said core rod.

11. The improvement of claim 9 wherein said abutment means is a tapered annular surface at an end of said threaded bore.

12. The improvement of claim 11 wherein said support block comprises a first plate having a bore therethrough accepting said core rod and a second plate having said threaded bore axially aligned with said bore in said first plate, said tapered annular surface being at an end of said bore in said first plate adjoining a corresponding end of said threaded bore.

13. The improvement of claim 8 wherein said core rod support block is attached to said die plate by means providing adjustment of said support block toward and away from said die plate.

14. The improvement of claim 13 wherein said means for adjustably mounting said core rod support block below said die plate comprises a variable length spacer.

15. The improvement of claim 14 wherein said variable length spacer comprises a sleeve member having a peripherally threaded portion, a threaded bore in each of said arms accepting the peripherally threaded portion of said sleeve, and a bolt passed through said sleeve member and threading at its end in a threaded aperture in said die plate.

* * * * *